US007030780B2

(12) United States Patent
Shiomi et al.

(10) Patent No.: US 7,030,780 B2
(45) Date of Patent: Apr. 18, 2006

(54) METHOD FOR DISPLAYING POSITION OF AN AIRCRAFT IN A DISPLAY FOR AIR TRAFFIC CONTROL

(75) Inventors: Kakuichi Shiomi, Tokyo (JP); Masanori Saito, Tokyo (JP)

(73) Assignees: Electronic Navigation Research Institute, Tokyo (JP); Realviz, Inc., Tokyo (JP)

( * ) Notice: Subject to any disclaimer, the term of this patent is extended or adjusted under 35 U.S.C. 154(b) by 10 days.

(21) Appl. No.: 10/831,298

(22) Filed: Apr. 26, 2004

(65) Prior Publication Data

US 2005/0035898 A1 Feb. 17, 2005

Related U.S. Application Data

(63) Continuation of application No. PCT/JP02/11001, filed on Oct. 23, 2002.

(30) Foreign Application Priority Data

Oct. 24, 2001 (JP) ..... 2001-325991

(51) Int. Cl.
*G08G 5/04* (2006.01)

(52) U.S. Cl. ..... 340/961; 340/963; 340/967; 340/969; 340/971; 340/973; 340/990; 340/995.1; 701/120; 701/208; 701/213; 701/216; 701/301

(58) Field of Classification Search ..... 340/961, 340/963, 967, 969, 971, 973, 990, 995.1; 701/120, 208, 213, 216, 301
See application file for complete search history.

(56) References Cited

U.S. PATENT DOCUMENTS

| | | | | |
|---|---|---|---|---|
| 5,339,085 | A | 8/1994 | Katoh et al. | |
| 5,636,123 | A * | 6/1997 | Rich et al. | 701/207 |
| 5,657,009 | A * | 8/1997 | Gordon | 340/968 |
| 6,021,374 | A * | 2/2000 | Wood | 701/301 |

FOREIGN PATENT DOCUMENTS

| | | |
|---|---|---|
| EP | 0 493 822 A1 | 7/1992 |
| JP | 57-53670 | 3/1982 |
| JP | 2-154183 | 6/1990 |
| JP | 3-40200 | 2/1991 |
| JP | 5-143900 | 6/1993 |
| JP | 6-34748 | 2/1994 |

(Continued)

*Primary Examiner*—Tai T. Nguyen
(74) *Attorney, Agent, or Firm*—Oblon, Spivak, McClelland, Maier & Neustadt, P.C.

(57) ABSTRACT

There is provided a method for displaying aircraft positions, which is capable of effectively avoiding the occurrence of near miss or collision. The method displays the terrain of an air space under air traffic control apparently in three dimensions on a display screen, displays aircraft marks at positions on the display screen so as to correspond to the three-dimensional positions of the respective aircraft, and displays a warning mark when a distance between two aircraft is shorter than a threshold value, wherein the warning mark comprises a triangle having three apexes, which comprise the aircraft marks, and a position that is apart from the aircraft mark of one of the aircraft along a vertical line extending perpendicular to the one aircraft toward a ground surface of the terrain by a distance corresponding to an altitude difference between both aircrafts on the display screen. A certain warning mark may be displayed when protective air spaces for both aircraft are predicted to conflict each other based on flight trajectories and flight conditions.

13 Claims, 10 Drawing Sheets

1 DATA PROCESSING UNIT, 2 CONTROL DESK
3 DISPLAY UNIT, 4 INPUT UNIT (VISUAL POINT CHANGE UNIT)
100 AIR TRAFFIC CONTROL INFORMATION COLLECTION UNIT
200 CONTROL UNIT
201 3D GRAPHIC ENGINE SECTION (POSITION DATA+ALTITUDE DATA —PREPARATION OF THREE-DIMENSIONAL IMAGE)
(TOPOGRAPHIC DATA—PREPARATION OF THREE-DIMENSIONAL MAP)
(PREPARATION OF SURVEILLANCE INSTRUCTION MARK)
202 GRAPHIC ENGINE SECTION (COMPOSITION OF IMAGE DATA=OVERWRITING)
(CONVERSION INTO COMPUTER IMAGE DATA)
203 IMAGE COMPOSITION SECTION, 205 INITIAL SETUP SECTION
206 DISPLAY CONTROL SECTION, 204 OPERATION SECTION
301 AIR TRAFFIC CONTROL INFORMATION MEMORY
302 TOPOGRAPHIC DATA MEMORY, 303 AIRCRAFT MARK MEMORY
304 DISTANCE BETWEEN TWO AIRCRAFT DATA MEMORY
305 REFERENCE DATA MEMORY
306 SURVEILLANCE INSTRUCTION MARK MEMORY

FOREIGN PATENT DOCUMENTS

| | | |
|---|---|---|
| JP | 8-110380 | 4/1996 |
| JP | 9-251600 | 9/1997 |
| JP | 9-304526 | 11/1997 |
| JP | 11-203600 | 7/1999 |
| JP | 2000-155900 | 6/2000 |

* cited by examiner

Fig. 1

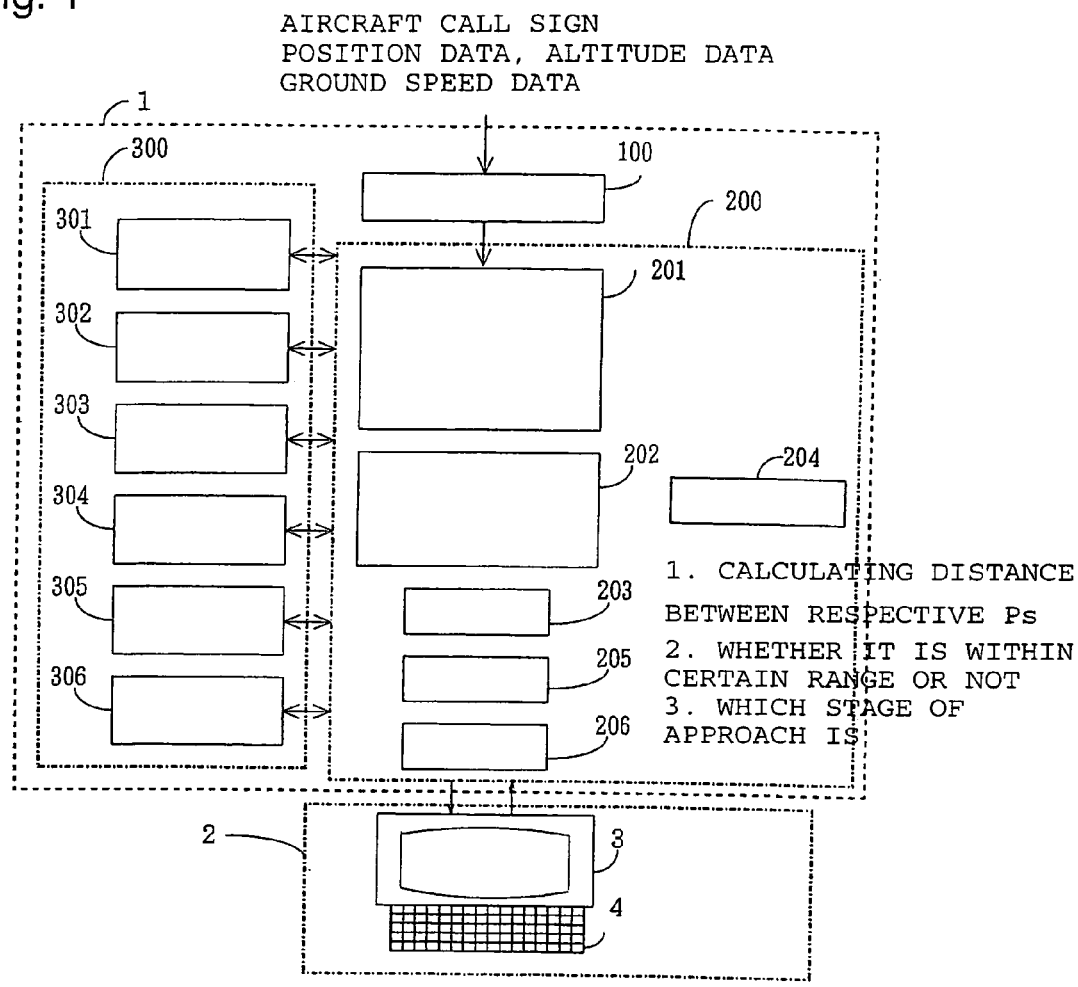

1 DATA PROCESSING UNIT, 2 CONTROL DESK
3 DISPLAY UNIT, 4 INPUT UNIT (VISUAL POINT CHANGE UNIT)
100 AIR TRAFFIC CONTROL INFORMATION COLLECTION UNIT
200 CONTROL UNIT
201 3D GRAPHIC ENGINE SECTION (POSITION DATA+ALTITUDE DATA →PREPARATION OF THREE-DIMENSIONAL IMAGE)
(TOPOGRAPHIC DATA→PREPARATION OF THREE-DIMENSIONAL MAP)
(PREPARATION OF SURVEILLANCE INSTRUCTION MARK)
202 GRAPHIC ENGINE SECTION (COMPOSITION OF IMAGE DATA=OVERWRITING)
(CONVERSION INTO COMPUTER IMAGE DATA)
203 IMAGE COMPOSITION SECTION, 205 INITIAL SETUP SECTION
206 DISPLAY CONTROL SECTION, 204 OPERATION SECTION
301 AIR TRAFFIC CONTROL INFORMATION MEMORY
302 TOPOGRAPHIC DATA MEMORY, 303 AIRCRAFT MARK MEMORY
304 DISTANCE BETWEEN TWO AIRCRAFT DATA MEMORY
305 REFERENCE DATA MEMORY
306 SURVEILLANCE INSTRUCTION MARK MEMORY

Fig. 3

PREPARATION OF SURVEILLANCE INSTRUCTION MARK

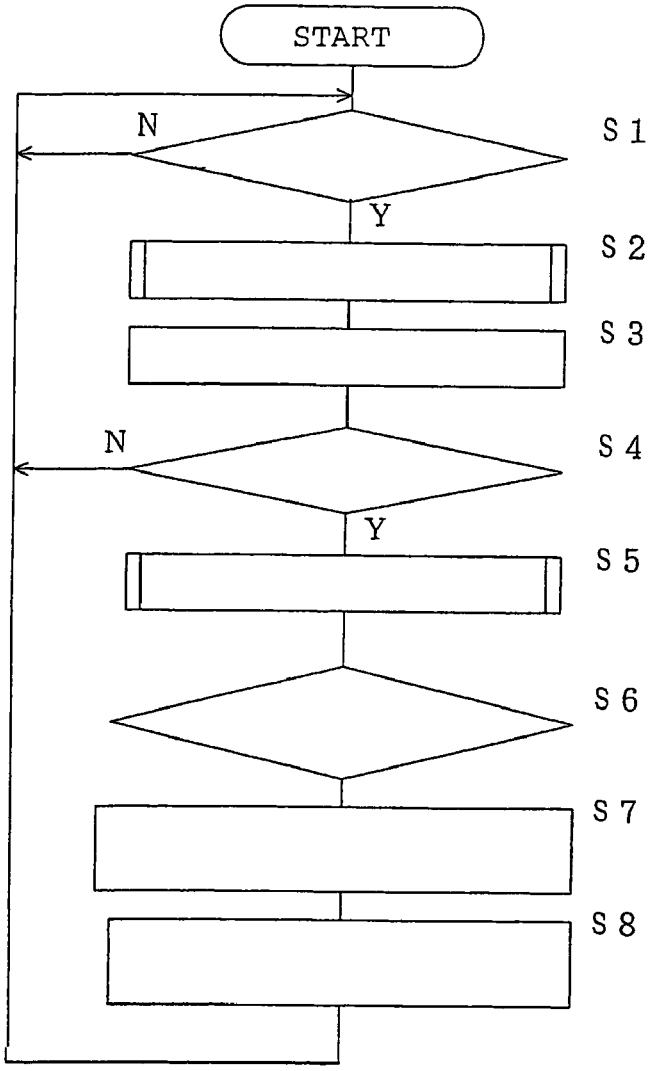

S1 ARE THERE APPROACHING AIRCRAFT?

S2 CALCULATE THE DISTANCE BETWEEN AIRCRAFT

S3 COMPARE D WITH THRESHOLD VALUE T

S4 D<T?

S5 PREPARATION OF SURVEILLANCE INSTRUCTION MARK

S6 WHICH ONE OF STAGES 1, 2 AND 3 D IS APPLIED TO

S7 SPECIFY DISPLAY PROPERTY OF SURVEILLANCE INSTRUCTION MARK ACCORDING TO APPLIED STAGE

S8 OUTPUT TO GRAPHIC ENGINE SECTION

FLOWCHART FOR DISPLAY CONTROL

S21 IS AIR TRAFFIC CONTROL INFORMATION INPUTTED?
S22 PERFORM STORING FOR EACH CALL SIGN
S23 PREPARE 3D MAP DATA
S24 PREPARE IMAGE DATA FOR 3D DISPLAY
S25 CONVERT INTO 2D DATA AND COMPOSE
S26 IS THERE SURVEILLANCE INSTRUCTION MARK?
S27 COMPOSE INTO 2D DATA
S28 IS THERE CHANGE IN DISPLAY?
S29 SET ROTATION ANGLE
S210 OUTPUT TO DISPLAY UNIT

A1, A2: AIRCRAFT

P-3～P-1: FLIGHT TRAJECTORY

P0: CURRENT POSITION

P-1～P5: ESTIMATED ARRIVAL POSITION

METHOD FOR DISPLAYING POSITION OF AN AIRCRAFT IN A DISPLAY FOR AIR TRAFFIC CONTROL

This is a continuation of application Ser. No. PCT/JP02/11001, filed Oct. 23, 2002.

TECHNICAL FIELD

The present invention relates to a method for displaying aircraft positions in a display system for air traffic control, which is capable of visually grasping the flight status of aircraft under air traffic control on a display screen, and which is particularly appropriate for the surveillance and the air traffic control of the flight status of multiple aircraft that come close to each other within a safety distance.

BACKGROUND ART

Tragic accidents by midair collision of aircraft have frequently occurred everywhere in the world. We have often been shocked to hear that near miss has occurred, though midair collision has not occurred fortunately.

In a conventional surveillance radar system, based on air traffic control information obtained from various kinds of radars, multiple range rings indicating a distance from a reference point on a runway on a ground surface, the symbols indicating aircraft under air traffic control, the data tag indicating the data including the flight number, the velocity and the altitude of the aircraft, and a lead line indicating relationships between the symbol and the data tag are displayed in two dimensions on a display screen, while the displayed status is renewed at certain cycles (scan cycles). And a controller has watched the display position of a symbol and learned the contents of a data tag to perform air traffic control. In other words, in the conventional air traffic control method, the position of aircraft, which actually exists in three dimensions, is displayed in a visually recognizable form by a symbol only in terms of position in an XY plane. The position of the aircraft in a Z axis direction, i.e., the altitude of the aircraft is displayed by a numerical value. Therefore, when the controller performs air traffic control work, he or she needs to combine the visually recognizable symbol and the altitude represented by the numerical value so as to image the flight status of the aircraft and needs to perform required air traffic control work, imaging the flight status. He or she needs to have a great deal of experience and make much effort before he or she can accurately image the flight status based on the position of the symbol and the numerical value. When multiple aircraft exist in an air traffic control area, there is a possibility that he or she incorrectly images the flight status since he or she bears a heavy burden. There is a possibility that his or her incorrect image causes near miss or midair collision.

Some technologies to avoid the occurrence of near miss or midair collision of aircraft are listed in JP-A- 2000-155900, which is to predict the approach to or collision with of an aircraft the ground. More specifically, three-dimensional elevation data of the terrain of an air traffic control area are stored, an estimated arrival range of the aircraft is set up based on the position and the velocity vector of the aircraft, a finite difference vector is found based on the position of the aircraft and the elevation data, and it is determined based on the finite difference vector and the velocity vector of the aircraft whether the above-mentioned elevation data are in the estimated arrival range of the above-mentioned aircraft.

(1) JP-A-3-40200 discloses a technique wherein the first aircraft is displayed in its own altitude plane, displayed apparently in three dimensions on a display screen therein, and a mark indicating the second aircraft that has been approaching to the first aircraft is displayed at a position on the display screen so as to correspond to the three-dimensional position of the second aircraft. However, it is impossible to comprehensively and visually grasp relative relationships such as the positions, the velocities and the travel directions of plural aircrafts at an air traffic control console with this technique.

(2) A system wherein the flight trajectory of aircraft is displayed in a three-dimensional reduced model space of an area surrounding an airport on a display screen based on aircraft position data detected by a radar system in air traffic control is disclosed in JP-A-8-110380.

However, in this technique, although it is possible to display the flight trajectories and the current positions of respective aircraft to a certain terrain, it is impossible to display relative relationships, such as the velocities, the travel directions, the inter-distance and the changing statuses of the respective aircrafts.

(3) JP-A-9-304526 discloses a technique wherein in order to visually recognize the positions, the velocities, the travel directions, the attitudes and the like of aircraft, a plane containing a reference point on a runway extending in substantially parallel with the ground surface is displayed as a reference plane apparently in three dimensions on a display screen, and the aircraft marks indicating of the respective aircrafts, the projection marks of the respective aircrafts projected onto the reference plane, the altitude vectors indicating the altitudes of the respective aircraft, the velocity vectors indicating the velocities of the respective aircraft and the trail vectors indicating the flight trajectories of the respective aircrafts are displayed apparently in three dimensions in a method for displaying air traffic control information. Although it is possible to grasp the positions, the altitudes, the velocities, the travel directions and the flight trajectories of the respective aircraft apparently in three dimensions with this technique, it is difficult to accurately and visually grasp relative relationships between the respective aircraft, in particular the distance and the changing status between the respective aircraft. It is impossible to visually grasp which one of neighboring aircraft a controller should pay more attention to and how much attention he or she should pay if caution is needed.

As explained, with the conventional techniques, it is difficult to predict the possibility of near miss or collision between aircraft in order to avoid the occurrence of the near miss or collision by comprehensively and visually grasping relative relationships between flying aircrafts including the distance between aircraft, the changing status in the distance between aircraft, and the travel directions of the respective aircraft.

There has been not proposed a display method for air traffic control, which is effective to display the flight status of aircraft under air traffic control on a display screen of a display system to grasp these items in order to avoid the occurrence of near miss or collision between aircraft.

DISCLOSURE OF INVENTION

It is a first object of the present invention to provide a method for displaying aircraft positions, which is capable of displaying relative relationships between aircraft under air traffic control, including the distances between two aircraft, and their changing status in the distances between aircraft, apparently in three dimensions (3D) on a display screen of a display system to comprehensively and visually grasp the relative relationships, which is capable of performing adequate surveillance by promptly predicting whether the near miss or collision between aircraft would occur, and which is capable of ensuring a safety distance between aircraft by sending a necessary control command in order to effectively avoid the occurrence of near miss or collision.

It is a second object of the present invention to provide a method for displaying aircraft positions, which is capable of avoiding the occurrence of near miss or collision by predicting whether the protective air space for at least two aircraft flying closer to each other would conflict each other and by issuing a warning if in the affirmative.

In order to attain the first object, according to a first aspect of the present invention, there is provided a method for displaying aircraft positions, which is characterized in that the method comprises displaying a terrain apparently in three dimensions on a display screen based on topographic data corresponding to an air space under air traffic control; finding three-dimensional positions of aircrafts based on position data and altitude data of the respective aircrafts contained in air traffic control information obtained about the air space under air traffic control, and displaying aircraft marks indicating the respective aircrafts at positions on the display screen so as to correspond to the three-dimensional positions of the respective aircrafts; finding an inter-distance between two neighboring aircraft, and determining whether the distance found is shorter than a preset threshold value; and displaying a surveillance instruction mark apparently in three dimensions on the display screen, the surveillance instruction mark comprising a triangle having three apexes, the three apexes comprising the aircraft marks of the two neighboring aircraft and a point having a specific relationship with the aircraft marks, when it is determined that the distance found is shorter than the threshold value.

As the surveillance instruction mark, it is acceptable to use any one of (a) a mark comprising a triangle having three apexes, which comprise the aircraft marks corresponding to the two neighboring aircraft, and a position that is apart from one of the aircraft marks along a vertical line extending perpendicular to the one aircraft toward a ground surface of the terrain by a distance corresponding to an altitude difference between both aircraft on the display screen; (b) a mark comprising a triangle having three apexes, which comprise both aircraft marks, and a projection point of one of the aircraft marks projected onto the ground surface of the terrain; and (c) a mark comprising a composition of two triangles, one of which has three apexes comprising one of the aircraft marks, and projection points of both aircraft marks projected onto the ground surface of the terrain, and the other of which has three apexes comprising the other aircraft mark, and the projection points of both aircraft marks projected onto the ground surface of the terrain.

According to a second aspect of the present invention, the method according to the first aspect is characterized in that the surveillance instruction mark is one of (a) a mark comprising a triangle having three apexes, which comprise the aircraft marks corresponding to the two neighboring aircrafts, and a position that is apart from one of the aircraft marks along a vertical line extending perpendicular to the one aircraft toward a ground surface by a distance corresponding to an altitude difference between both aircrafts on the display screen; (b) a mark comprising a triangle having three apexes, which comprise both aircraft marks, and a projection point of one of the aircraft marks projected onto the ground surface; and (c) a mark comprising a composition of two triangles, one of which has three apexes comprising one of the aircraft marks, and projection points of both aircraft marks projected onto the ground surface of the terrain, and the other of which has three apexes comprising the other aircraft mark, and the projection points of both aircraft marks projected onto the ground surface of the terrain.

According to a third aspect of the present invention, the method according to the first or second aspect is characterized in that the method further comprises finding the distance between the two neighboring aircraft based on the position data and the altitude data with respect to the two neighboring aircraft; and displaying the surveillance instruction mark with different display properties according to which one of multiple stages of the distance ranges indicating a degree of approach is applied to, when the aircraft distance between the aircraft is shorter than the threshold value.

According to a fourth aspect of the present invention, the method according to the third aspect is characterized in that the display properties of the surveillance instruction mark are set so as to have stronger appeal as the degree of approach between both aircrafts increases.

According to a fifth aspect of the present invention, the method according to the first, second, third or fourth aspect is characterized in that travel directions and ground speeds of the two neighboring aircraft are indicated by vectors based on travel direction data and ground speed data contained in the air traffic control information transmitted from the two neighboring aircraft, the vectors extending from the respective aircraft marks in the respective travel directions and having graduations.

According to a sixth aspect of the present invention, the method according to the first, second, third, fourth or fifth aspect is characterized in that the vertical lines extending from the respective aircraft marks onto the ground surface of the terrain are painted in different colors to see whether each of the aircraft is ascending or descending.

According to a seventh aspect of the present invention, the method according to the first, second, third, fourth or fifth aspect is characterized in that the vertical lines extending from the respective aircraft marks onto the ground surface of the terrain are painted in different colors to see whether each of the aircraft is ascending or descending, and that ground speed levels of the aircrafts are indicated by different thicknesses of the vertical lines.

According to an eighth aspect of the present invention, the method according to any one of the first to seventh aspects is characterized in that the aircraft marks are stored as reduced stereoscopic models, which have respective sizes proportional to sizes of the respective aircraft; and the aircraft marks of the respective aircraft are displayed by the reduced stereoscopic models of the respective aircraft based on call signs contained in the air traffic control information obtained about the air space under air traffic control.

According to a ninth aspect of the present invention, the method according to the eighth aspect is characterized in that the reduced stereoscopic models are displayed so as to have attitudes accorded with respective travel directions based on travel direction data contained in the air traffic control information or based on respective travel directions determined based on respective flight trajectories of the aircraft obtained by processing the air traffic control information.

In order to attain the second object, according to a tenth aspect of the present invention, there is provided a method, which is characterized in that the method comprises 1) displaying a terrain apparently in three dimensions on a display screen based on topographic data corresponding to an air space under air traffic control; 2) finding three-dimensional positions of respective aircrafts based on position data and altitude data of the respective aircraft contained in air traffic control information obtained about the air space under air traffic control, and displaying aircraft marks indicating the respective aircrafts at positions on the display screen so as to correspond to the three-dimensional positions of the respective aircrafts; 3) finding a distance between two neighboring aircraft, and determining whether the distance between two aircraft found is shorter than a threshold value preset as a safety distance; 4) displaying a surveillance instruction mark and a warning mark apparently in three dimensions on the display screen when it is determined that the distance between two aircraft found is shorter than the threshold value, wherein the surveillance instruction mark comprises a triangle having three apexes, which comprise the aircraft marks corresponding to the two neighboring aircraft, and a position that is apart from one of the aircraft marks along a vertical line extending perpendicular to the one aircraft toward a ground surface of the terrain by a distance corresponding to an altitude difference between both aircraft on the display screen, and wherein the warning mark comprises a triangle having three apexes, which comprise a point in an overlapped range and both aircraft marks, when estimated arrival ranges of both aircrafts after a certain period of time are supposed to be overlapped each other in a preset range according to prediction of flight up to lapse of the certain period of time, which is performed based on flight trajectories and flight conditions of the two neighboring aircrafts.

According to an eleventh aspect of the present invention, the determination of whether the inter-aircraft distance is shorter than the threshold value in the tenth aspect is characterized to be performed so that when it is determined that the inter-aircraft distance is shorter than the threshold value, a triangle is formed so as to have three apexes comprising the aircraft marks corresponding to the two neighboring aircraft, and a position that is apart from one of the aircraft marks along a vertical line extending perpendicular to the one aircraft toward the ground surface of the terrain by the distance corresponding to the altitude difference between both aircraft on the display screen, and that a triangular pyramid is displayed as a warning mark when protective ranges for both aircraft after a certain period of time are supposed to be overlapped each other according to flight prediction performed based on flight trajectories and flight conditions of the two neighboring aircraft, the warning mark connecting the three apexes of the triangle and a point in an overlapped range for both aircrafts.

According to a twelfth aspect of the present invention, the method according to any one of the first to eleventh aspects is characterized in that the aircraft marks are displayed in an interpolated way by displaying the aircraft marks on the display screen based on latest air traffic control information obtained about the respective aircrafts, following by performing processing of interpolation by making use of flight trajectory information of the respective aircraft until obtaining next air traffic control information.

According to a thirteenth aspect of the present invention, the method according to the twelfth aspect is characterized in that when display has been renewed based on the latest air traffic control information, the aircraft marks are displayed not only in the interpolated way but also in a emphatic way for recognition of renewal.

BRIEF DESCRIPTION OF DRAWINGS

FIG. 1 is a block diagram showing the structure of an aircraft position display system using the method according to the present invention;

FIG. 3 is a flowchart explaining the processing of preparation of the surveillance instruction mark and related operations;

BEST MODE FOR CARRYING OUT THE INVENTION

Figure 2:
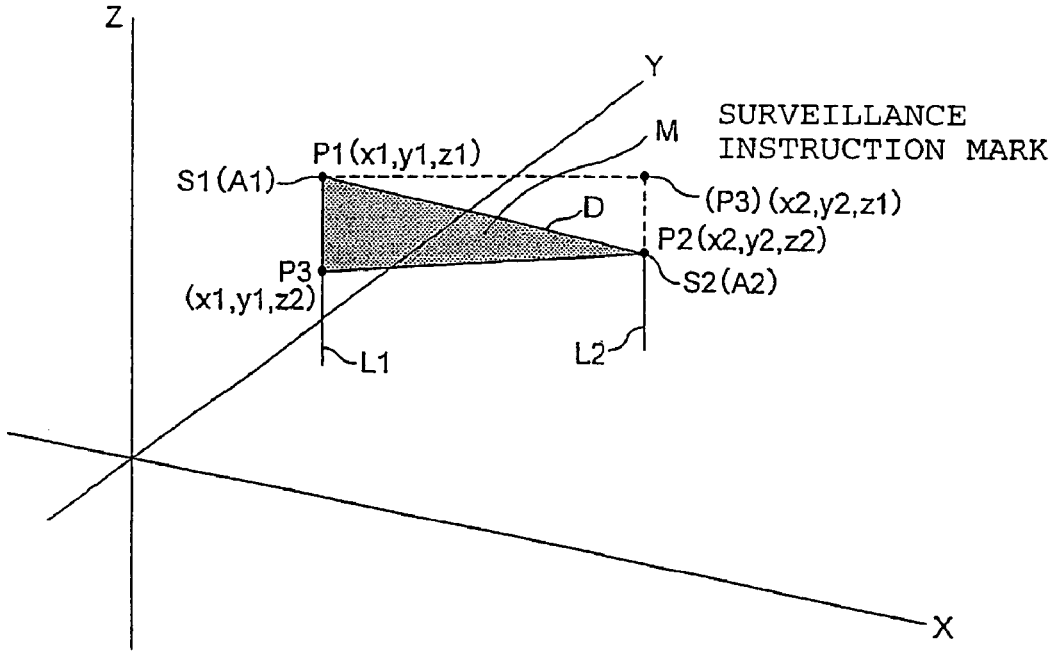
FIG. 2 is a schematic view explaining the principles of finding the distance between two neighboring aircraft and preparing of a surveillance instruction mark.

Turning now to explanation in reference to the accompanying drawings, an aircraft position display system according to the present invention generally comprises a data processing unit 1, a display unit 3 provided on a control console 2, and an input unit 4 connected to the display unit as shown in FIG. 1.

The data processing unit 1 includes an air traffic control information collection unit 100, a control unit 200 for processing collected air traffic control information for the purpose of accomplishing a desired purpose and for performing control operation, and a storage unit 300 for storing data originally prepared, data to be inputted from outside and data as a result of data processing by the control unit 200, respectively.

The air traffic control information collection unit 100 collects air traffic control information containing certain data, including the call sign (flight name), the current position, the travel direction and the ground speed of an aircraft existing in an air traffic control area (air space).

Collection of the air traffic control information may be performed by inputting data obtained from a known traffic control radar system into the air traffic control information collection unit 100 as disclosed in JP-A-8-110380, JP-A-9-304526, JP-A-11-174150 and JP-A-2001-148100, or instead by inputting data obtained by a combination of a radar system as disclosed in JP-A-9-5432 and a GPS (Global Positioning System) into the air traffic control information collection unit 100. If there is adopted a system wherein each of aircrafts is provided with a GPS and a responder, and each of the aircrafts replies with data, including the call sign, the travel direction and the ground speed of the aircraft, added to the position data and the altitude data obtained from the GPS in response to an interrogation from a ground station (control station), the replied data may be inputted into the air traffic control information collection unit 100.

The storage unit 300 has a system program for accomplishing the functions of the aircraft position display system stored therein and includes an air traffic control information memory 301 for storing control data collected by the air traffic control information collection unit 100, a topographic data memory 302 for storing topographic data of an airport and its surrounding area, an aircraft mark memory 303 for storing three-dimensional images of aircraft marks (symbols) symbolically showing the aircrafts, a distance between aircraft data memory 304, a reference data memory 305 and a surveillance instruction mark memory 306.

Air traffic control information, which has been collected by the air traffic control information collection unit 100, is stored in the air traffic control information memory 301 for each flight number of each aircraft. Since the air traffic control information is inputted from, e.g., the traffic control radar system at certain intervals (scan cycles), air traffic control information inputted in a certain period of time and the latest air traffic control information renewed with respect to aircraft existing in an area under air traffic control are stored in the air traffic control information memory 301.

The latest air traffic control information is utilized as the current position data (X, Y, Z), the current travel direction data and the current ground speed data of the aircraft existing in the area. The air traffic control information in the certain period of time is utilized for analysis of flight trajectory data and, if needed, for flight prediction.

The topographic data memory 302 has a three-dimensional reduced model space of the terrain of the area under air traffic control (such as an airport and a surrounding area within about 100 Km of it) stored as an image data therein. The image data may be arbitrarily changed according to an airport to apply the present invention. The three-dimensional reduced model space means a stereoscopic model space, which is provided by showing the actual space surrounding an airport in a reduced scale for display on the display unit 3.

Although the aircraft marks to be stored in the aircraft mark memory 303 may be formed from, e.g., a recognizable dot, a sign of X or a sign of ♦, each of the aircraft marks are formed as a reduced stereoscopic model having a size proportional to the size of the corresponding aircraft in a preferred embodiment of the present invention.

With regard to another example of the reduced stereoscopic model, the actual sizes of aircraft may be classified into multiple kinds, such as a large size, a medium size and a small size, and the reduced stereoscopic models showing aircraft marks may be shown by using reduced stereoscopic models symbolically showing the sizes of respective kinds of aircrafts.

The aircraft mark memory 303 has the call signs and the identification codes of the reduced stereoscopic models of the respective aircrafts stored so as to be mapped each other therein. Thus, based on the call signs contained in the air traffic control information obtained with respect to the air space under air traffic control, the aircraft mark of an aircraft is shown in a reduced stereoscopic model, which has a size proportional to the actual size of the aircraft or has a shape symbolically showing the size of the aircraft.

The distance between two aircraft data memory 304 serves to temporarily store the distance between two neighboring aircrafts, when the distance between two aircraft is found by calculation as stated later.

When the distance between two aircraft is shorter than a safety distance defined in the air apace under air traffic control, the calculation of the distance between two aircraft is repeatedly performed at certain periods until the distance between two aircraft becomes greater than the safety distance, and the finally calculated value is temporarily stored. The safety distance is defined according to the flight frequency or the degree of congestion in the area surrounding each airport and ranges from RNP4 (4 miles) to RNP10 (10 miles) at the present stage.

The reference data memory 305 has a threshold value as the reference stored therein to determine whether the distance between two aircraft is shorter than the safety distance.

In a preferred embodiment of the present invention, reference data are stored for determination of multiple stages according to the degree of approach between both aircraft when the distance between two aircraft is shorter than the threshold value: e.g., Stage 1 in the case of a small approach (wherein the distance between both aircraft is from 8 to not shorter than 5 miles for instance), Stage 2 in the case of medium approach (wherein the distance between two aircraft is from shorter than 5 miles to not shorter than 2 miles for instance), and Stage 3 in the case of a great approach (wherein the distance between two aircraft is shorter than 2 miles for instance).

The surveillance instruction mark memory 306 has surveillance instruction marks stored therein so that a surveillance instruction mark, which is prepared in the processing of surveillance instruction mark preparation, can be displayed on the display unit 3 as stated later when the distance between two aircraft is shorter than the safety distance.

The control unit 200 includes a 3D graphic engine section 201, a graphic engine section 202, an image composition section 203, an operation section 204, an initial setup section 205 and a display control section 206, each of which is made of software.

The control unit 200 performs search in the air traffic control information memory 301 at certain periods to ascertain whether air traffic control information is stored. If in the affirmative, the control unit provides the air traffic control information to the 3D graphic engine section 201.

The 3D graphic engine section 201 has three functions of preparation of three-dimensional images for displaying the positions of aircrafts with an aircraft marks (symbols) by using the latest air traffic control information for the respective aircraft stored in the air traffic control information memory 301, preparation of a three-dimensional map for displaying the terrain surrounding an airport by using the topographic data, and preparation of a surveillance instruction mark wherein the surveillance instruction mark is prepared in order that the positions of two aircrafts within the safe distance and changing relative statuses between the aircraft are displayed to draw a controller's attention.

In the preparation of a three-dimensional image, the 3D graphic engine section 201 obtains relevant calls sign in the air traffic control information given from the air traffic control information memory 301 through the control unit 200, reads aircraft marks from the aircraft mark memory 303 by using the identification codes corresponding to the call signs, and prepares aircraft marks, each of which is formed from a reduced stereoscopic model having a size proportional to the size of the aircraft or a reduced stereoscopic model symbolically showing the kind of the aircraft in terms of size.

When the reduced stereoscopic model of a aircraft mark has a form symbolically showing the kind of the aircraft in terms of size, the 3D graphic engine section 201 has a relevant call sign inputted thereto and prepares an aircraft mark forming from a reduced stereoscopic model corresponding to the kind of the aircraft in terms of size by using the identification code corresponding to the call sign.

The 3D graphic engine section 201 is configured to perform the preparation of aircraft marks so that the direction (attitude) of the aircraft marks corresponding to respective aircrafts are displayed so as to accord with the travel directions of the respective aircraft on a display screen based on the travel direction data contained in the air traffic control information.

The graphic engine section 202 is connected to the 3D graphic engine section 201. The graphic engine section 202 converts the three-dimensional images of aircraft marks, a terrain and a surveillance instruction mark prepared by the 3D graphic engine section into computer image data for two-dimensional display in order that the converted images are displayed on the display screen of the display unit 3 so as to correspond to the positions of the aircrafts.

The image composition section 203 serves to perform composition by overwriting, on a map data, the image data of aircraft marks and a surveillance mark or a warning mark stated later, which are obtained from the graphic engine section 202.

The display control section 206 in the control unit 200 is connected to the display unit 3, which displays an airport control image in three dimensions based on composition of the image data of the aircraft marks and the topographic data. The composite data as the two-dimensional display data, which have been obtained by the image composition section 203, are provided to the display unit 3 to be displayed under the control of the display control section 206.

The control unit 200 has the initial setup section 205 housed therein to set the rotation angle of display on the display screen by the display unit 206 at start. When the system starts, the rotation angle is set at an initial set value, and the terrain surrounding an airport is displayed on the display unit 3 based on the image data outputted from the graphic engine section 202 while the aircraft marks are displayed at certain coordinate positions in the displayed terrain.

The display unit 3 has the input unit 4 comprising a visual point change unit provided thereto and in the vicinity thereof and is connected to the control unit 200. The visual point change unit is configured to be capable of specifying a rotation angle parameter by, e.g., a keyboard or a trackball. Watching the contents displayed on the screen of the display unit 3, a controller performs manipulation to change the rotation angle on the display screen at an arbitrary time by modifying the rotation angle, when an image composed by the image composition section 203 is displayed on the display unit 3. In other words, it is possible to change the display state (angle) in a three-dimensional image for airport control according to visual point changing manipulation at the visual point change unit.

By using the air traffic control information stored in the air traffic control information storage unit 301, the operation section 204 performs calculation processing for calculating the distance between aircrafts existing in the area under air traffic control, first determination processing for determining by comparison with the threshold value whether the distance between two aircraft calculated is smaller than the safety distance, and second determination processing wherein, when the distance between two aircraft is determined as being shorter than the safety distance, it is determined which one of Stage 1, Stage 2 and Stage 3 the degree of approach is applied to. In other words, the operation section has a calculation processing function for calculating the distance between two aircraft, a first determination processing function for determining whether the calculated value is longer or shorter than the threshold value and a second determination processing function for determining the degree of approach when the calculated value is less than the threshold value.

The principles of calculation processing of the distance between two aircraft and preparation of the surveillance instruction mark, and the processing operation will be described based on FIG. 2 and FIG. 3.

When the air traffic control information display system starts, relevant data are read from the air traffic control information memory 301, and it is checked whether there are neighboring aircraft existing in an area under air traffic control (S1). If in the affirmative, the calculation processing for calculating the distance between two aircraft is performed as stated below (S2).

Assuming that the position data of the current positions P1 and P2 of the two neighboring aircraft A1 and A2 are (x1, y1, z1) and (x2, y2, z2) as shown in FIG. 2 as an example, the difference in altitude between the two aircraft (z1−z2) is found based on these position data at first place, and the position data (x1, y1, z2) of a position P3, which is apart from the position of one of the aircraft (e.g., A1) by the distance corresponding to the difference in altitude (z1−z2) between the two aircraft (A1, A2) along the perpendicular line L1 perpendicularly extending from the one aircraft to the ground surface, is prepared at the second place. Although the position that is lowered from the position P1 of the aircraft A1 having a higher altitude by the difference in altitude along the perpendicular line L1 as in the example shown in FIG. 2 is defined as P3, the position that is raised from the position P2 of the aircraft A2 having a lower altitude by the difference in altitude along the perpendicular line L2 as shown dotted lines in FIG. 2 may be defined as P3.

Then, a triangle is prepared so as to have P1 (x1, y1, z1), P2 (x2, y2, z2) and P3 (x1, y1, z2), or P1 (x1, y1, z1), P2 (x2, y2, z2) and P3 (x2, y2, z1) as three apexes.

Next, assuming that the distance between the two aircraft A1 and A2 is defined as D, D is found according to the following formula, and the data of the distance between two aircraft D is stored in the distance between two aircraft data memory 305 (S2):

$$D=\sqrt{(x1-x2)^2+(y1-y2)^2+(z1-z2)^2}$$

Next, the operation section 108 compares the value of D as the distance between aircraft with the threshold value T set and stored in the reference data storage 305 as the first determination processing function (S3). When D is smaller than T, the operation section outputs a caution signal, which is inputted in the 3D graphic engine section 201.

Base on the caution signal inputted, the 3D graphic engine section 201 performs the preparation of a surveillance instruction mark wherein the surveillance instruction mark (M in FIG. 2) is prepared so as to comprise a triangle having the three apexes at the coordinate positions P1, P2 and P3 corresponding to the triangle (x1, y1, z2) having the three apexes at the coordinate positions P1, P2 and P3, which in turn correspond to the position data (x1, y1, z1), (x2, y2, z2) and (x1, y1, z2) relevant to the caution signal (S5). The surveillance instruction mark thus prepared is stored in the surveillance instruction mark memory 306.

The operation section 108 subsequently performs the second determination processing function to determine which one of Stages 1 to 3 indicating the degree of approach the value D of the distance between two aircraft is applied to (S6), outputs either one of a signal indicating Stage 1, a signal indicating Stage 2 and a signal indicating Stage 3 according to applied Stage and generates a specific signal specifying a display property according to the outputted stage signal so as to be capable of easily distinguishing which one of stages the surveillance instruction mark is applied to (S7), and outputs the specific signal to the graphic engine section 202 (S8).

In the case of Stage 1, a display property, which has small appeal to, e.g., a controller watching the display screen, is specified since it is a stage wherein the two aircraft have made a small approach and the degree of danger is still low. In the case of Stage 2, a display property, which has relatively greater appeal to, e.g. the controller, is specified since it is a stage wherein the two aircraft have made a medium approach and the degree of danger is slightly higher. In the case of Stage 3, a display property, which has greater appeal to, e.g. the controller, is specified since it is a stage wherein the two aircrafts have made a great approach and the degree of danger is higher. The display control section 206 displays the surveillance instruction mark M having a certain display property on the display screen based on the specific signal.

In the case of Stage 3, it is preferable from the viewpoint of ensuring attention that the surveillance instruction mark M is flickered or that a beep is generated from a speaker (not shown) attached to the display unit 3.

Figure 4:
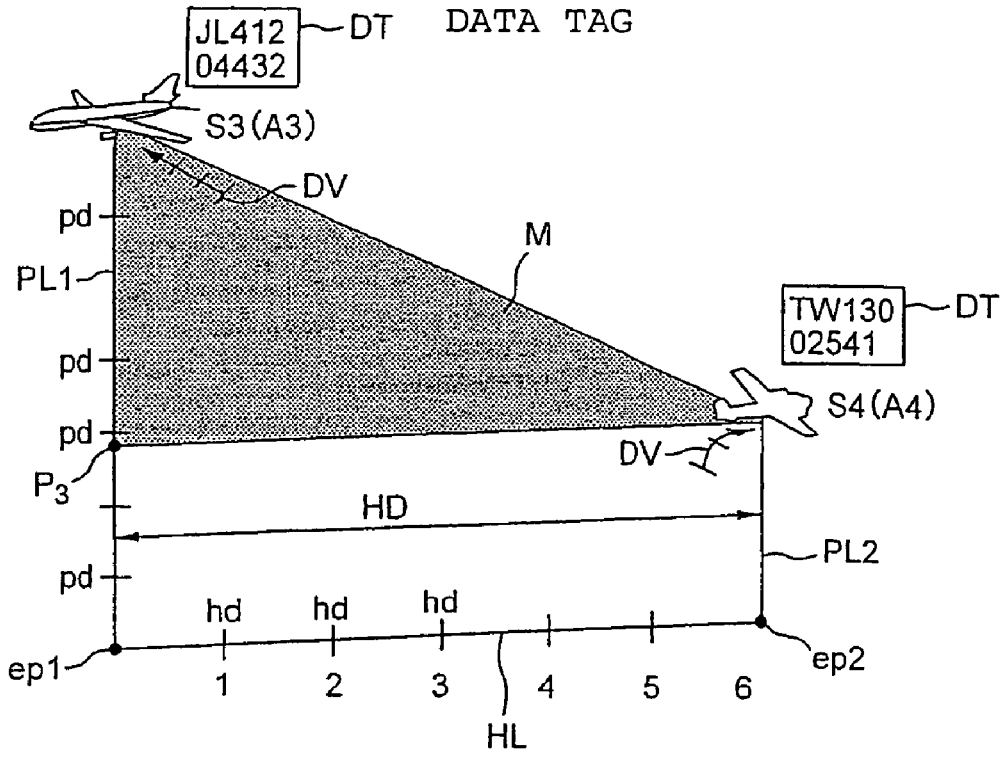
FIG. 4 is a schematic view showing an example of an improved screen display.

In a preferred embodiment, as shown in FIG. 4 as an example, the identification codes corresponding to relevant call signs contained in the collected air traffic control information are read from the aircraft mark memory 303, and the aircraft are displayed with aircraft marks S3 and S4, which comprise reduced stereoscopic models having sizes corresponding to the identification codes. Based on the travel direction data contained in the collected air traffic control information, the 3D graphic engine section 201 performs image processing to display the aircraft marks in such attitudes so as to accord with the actual travel directions of the respective aircrafts.

Thus, it is possible to understand the sizes and the travel directions of the aircrafts at a glance by only seeing the aircraft marks on the display screen as shown in FIG. 4.

The function of the aircraft position display system thus constructed will be described, referring to FIG. 5.

When the system starts, it is first checked whether the air traffic control information collection unit 100 has air traffic control information inputted therein or not (S21). Whenever air traffic control information is newly inputted, the newly inputted information is stored in the air traffic control information memory 301 for each call sign to accumulate the air traffic control information for a certain period of time (S22).

On the other hand, relevant topographic data are read from the topographic data memory 302, and the 3D graphic engine section 201 prepares 3D map data based on the relevant topographic data (S23). Subsequently, based on the air traffic control information stored in the air traffic control information memory 301, the 3D graphic engine section 201 performs processing of preparation of image data for 3D display in order to display the aircraft marks at positions on the display screen so as to correspond to the actual positions of the aircrafts (S24). At this time, based on the relevant call signs contained in the air traffic control information, the reduced stereoscopic models having sizes corresponding to the sizes of the aircrafts are read from the air traffic control information memory 301, and the attitudes (directions) of the reduced stereoscopic models are determined so as to accord with the travel directions contained in the air traffic control information.

Subsequently, the graphic engine section 202 converts the 3D map data and the image data for 3D display of the aircraft marks into two-dimensional data for two-dimensional display on the display unit 3 and overwrites the aircraft marks on the map data to compose both data (S25).

On the other hand, whenever the air traffic control information collection unit 100 has air traffic control information inputted therein, the processing of calculation of the distance between two aircraft and the processing of preparation of the surveillance instruction mark, which are stated with respect to FIG. 2, are performed in parallel.

Figure 5:
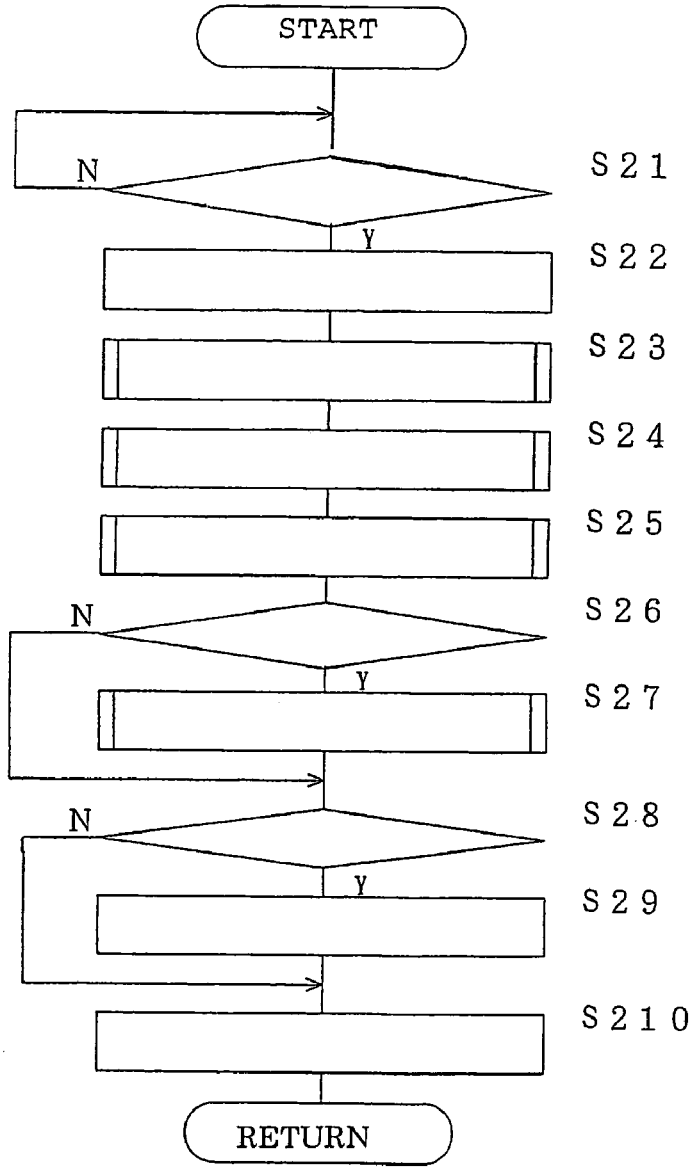
FIG. 5 is a flowchart explaining the processing for displaying a terrain, aircraft marks and the surveillance instruction mark on a display screen and operations for control.

After the processing of conversion of the map data and the data on the aircraft marks into two-dimensional data and the composition of both data have been performed as shown in FIG. 5 (S25), the surveillance instruction mark memory 306 is accessed to check whether there is the prepared surveillance instruction mark or not (S26). When there is the surveillance instruction mark, the surveillance instruction mark is also overwritten on the two-dimensional data to be composed (S27). It is checked whether the input unit 3 of the control desk 3 is manipulated to input a change in display or not (S28). When there is the surveillance instruction mark, this processing is immediately performed. When there is no surveillance instruction mark, this processing is performed after composition of the data. When there is no input, the display control section 206 provides the display unit 3 with the data for screen display outputted from the graphic engine section 202 with a rotation angle specified by the initial setup section 205 being maintained (S210). When there is manipulation for a change in display, the data for screen display outputted from the graphic engine section 202 is set at the inputted rotation angle for screen display in accordance with the manipulation (S29) and is outputted to the display unit 3 (S210).

Figure 6:
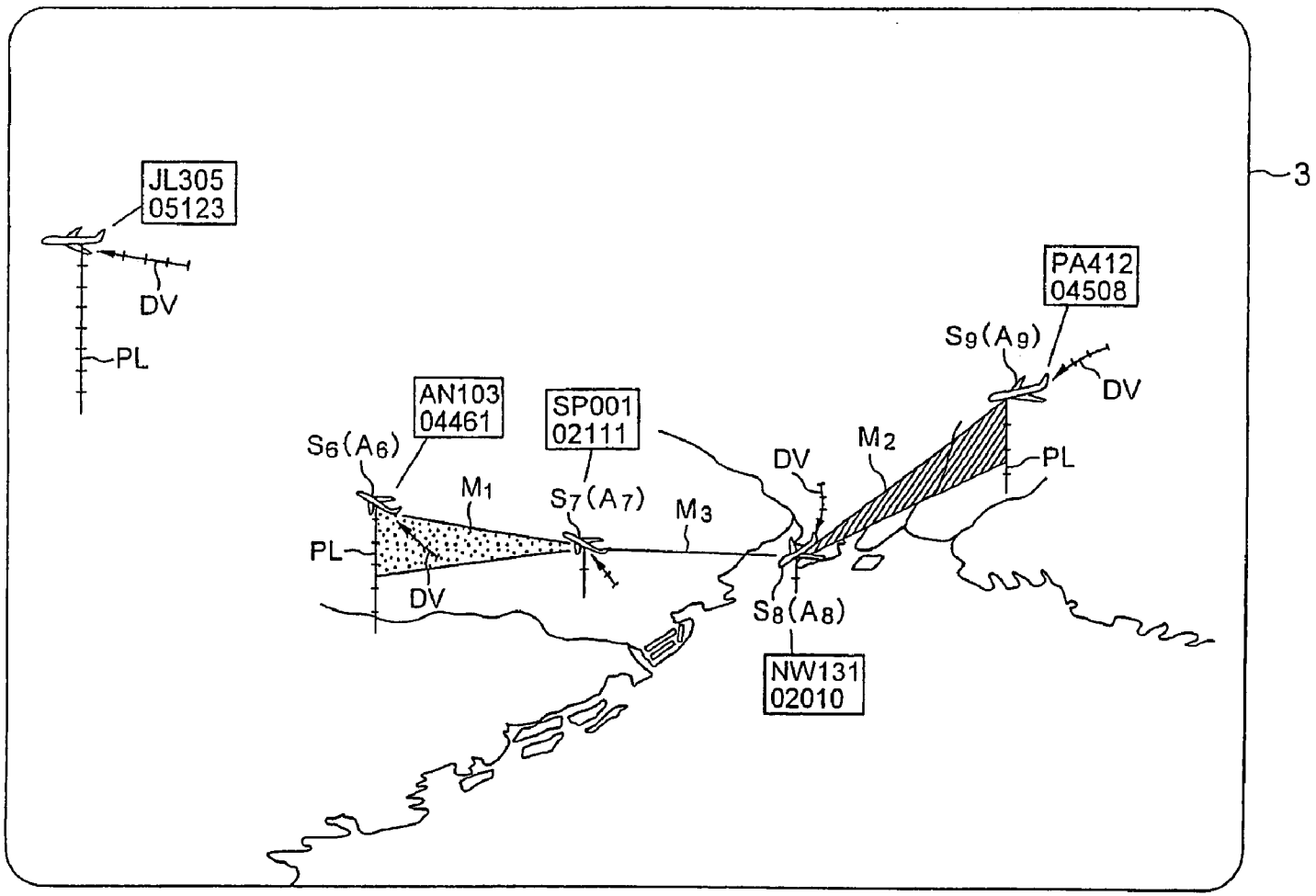
FIG. 6 is a schematic view showing an example of a display screen wherein the flight status of aircraft under air traffic control are displayed apparently in three dimensions way by the display system.

Thus, as shown in FIG. 6 as an example, aircraft marks S5 to S9, which are represented by reduced stereoscopic models having sizes proportional to the sizes of the respective aircrafts, are displayed at positions corresponding to the actual positions of the respective aircrafts with certain angles to the ground surface in the background showing an airport and its surrounding space represented apparently in three dimensions on the display screen 3' of the display unit 3 so that the attitudes of the aircraft marks accord with the travel directions of the respective aircraft.

The explanation stated earlier has been made about the processing of the air traffic control information and the display control in one cycle (one scan cycle). When the processing up to the output control (S210) of the image data to the display unit has been performed, the processing returns to Step S21 as the first step. In the next cycle, similar data processing and similar display control are sequentially performed again based on the air traffic control information stored in the air traffic control information memory, and the displayed positions of the respective aircraft marks move according to the actual movements of the respective aircrafts.

In this regard, there is a case that it is difficult to recognize the actual position of an aircraft because of a flight speed since the new display position of the aircraft mark, which is prepared based on the air traffic control information collected in the current scan time, is displayed in such a way so as to skip from the former display position of the aircraft mark, which has been prepared based on the air traffic control information collected in the previous scan time. In this case, it is preferable to perform the following processing of interpolated display in order to solve or ease the difficulty.

Specifically, the operation section 204 is provided with a function of Kalman Filter to find the estimated arrival position of an aircraft at the next scan time with respect to the current position of the aircraft based on the air traffic control information stored in the period from the latest scan cycle to the scan cycle several times before with respect to the aircraft in the air traffic control information memory 301, i.e., the flight trajectory data. By processing in the 3D graphic engine section 201 and under control of the display control section 206, the aircraft mark for the aircraft is apparently repeatedly displayed in a section from the display position for the current position of the aircraft to the display position for the estimated arrival position at the next scan time by being displayed in a successively or intermittently staggered fashion in the section until the aircraft mark based on the air traffic control information at the next scan time is displayed.

Thus, it is possible to effectively avoid misunderstanding of a flight status, which can be created because the aircraft mark is failed to be displayed momentarily under the influence of the scan cycle.

Referring to FIG. 6, surveillance instruction marks M1 and M2 are displayed in the section between aircraft A6 and A7 and in the section between aircrafts A8 and P9 since the distance between the aircrafts A6 and A7 and the distance between the aircrafts A8 and P9 are shorter than the safety distance, respectively.

It is seen that the vertical side of the triangle indicating one of the surveillance instruction marks extends perpendicularly from the aircraft mark for the one of the aircraft (A6 or A9). By seeing the surveillance instruction marks, it is obviously understandable for one of the neighboring pair of aircraft to have a higher altitude than the other (A7 or A8), and it is possible to easily estimate the degree of the altitude difference based on the length of the vertical side.

When the vertical lines PL connecting between the respective aircraft marks and the ground surface are displayed, and when graduations pd indicating heights from the ground surface are marked on the vertical lines in every unit of distance as shown in FIG. 4, it is possible to recognize the altitudes of the respective aircrafts by seeing the vertical lines. It is also possible to more precisely recognize the altitude difference of both aircrafts.

When graduations hd or a combination of graduations and successive figures are marked on the linear line connecting between the projection points ep1 and ep2 of the respective aircraft marks projected onto the ground surface in every unit of distance as shown in FIG. 4 as an example, it is possible to easily recognize the distance between the neighboring aircraft on the ground surface.

Additionally, it is possible to recognize the sizes of the respective aircraft more promptly and precisely than a case wherein a controller recognizes the sizes of the respective aircrafts in reliance on his or her memory based on the call signs indicated in data tags DT since the respective aircraft marks A3 to A9 in FIG. 4 and FIG. 6 indicate the sizes of the aircrafts as well.

Thus, when two neighboring aircrafts are closer than the defined safety distance, the relative positional relationship is displayed by a surveillance instruction mark M, which has different display properties according to the degree of approach. As the degree of approach is increasing, the surveillance instruction mark exhibits a display property having greater appeal.

Air traffic control information is sequentially inputted at certain cycles. The surveillance instruction mark varies momentarily and dynamically in terms of shape and display mode according to the positions, the altitudes and the travel directions, and a change in the relative positional relationship with respect to two aircrafts displayed at both ends of an upper side of the surveillance instruction mark displayed on the display screen.

Although the distance between the aircrafts A6 and A7 indicated by the aircraft marks S7 and S8 in FIG. 6 is also shorter than the safety distance, the surveillance instruction mark M3 is not formed in a triangle shape but a single straight line since both aircrafts have an almost equal altitude. When the straight line is thin, the straight line is inferior in terms of visibility. When the surveillance instruction mark is not formed in a triangle shape, it is preferable that the processing of preparation of the surveillance instruction mark is performed so that the straight line is enough thick to have sufficient visibility.

When aircrafts are flying in directions of being closer to each other, the display property of the surveillance instruction mark changes in such a way so as to gradually increase a controller's attention. Conversely, when aircrafts are flying in directions of being apart from each other, the display property of the surveillance instruction mark changes in such a way so as to gradually decrease the controller's attention. When the distance between two aircraft becomes greater than the safety distance, the surveillance instruction mark disappears. Thus, the controller can grasp the flight status of respective aircraft comprehensively and visually from the display screen. When a surveillance instruction mark is displayed, he or she can adequately determine whether air control is needed on not, paying his or her attention to the changing status of the surveillance instruction mark. When a surveillance instruction mark that is considered to require severe surveillance among the surveillance instruction marks in FIG. 6 is clicked by a cursor key (not shown) connected to the display unit, the surveillance instruction mark requiring severe surveillance and its surrounding area can be displayed in enlargement as shown in FIG. 4. It is possible to change the rate of enlargement by making the pushing time of the cursor key longer or shorter.

Although other display contents are omitted in FIG. 4 for simply showing a basic portion, aircraft data including call signs, altitudes and ground speeds, are displayed in data tags DT in the vicinity of the display positions for the respective aircraft marks S3 and S4 as usual. By clicking a data tag DT with the cursor key, it is possible to use a well-known surveillance radar system provided outside the system to transmit a required flight control command to the relevant aircraft.

When the vertical lines PL, each of which connects between each of aircraft marks and the ground surface, are displayed as shown in FIG. 2 and FIG. 4 as preferred embodiments, it is easy to visually recognize the positions of the respective aircrafts to the actual terrain on the display screen. As seen from FIG. 3, FIG. 4 and FIG. 6, the relative positional relationship between two aircrafts is represented by the surveillance instruction mark M, M1 or M2. The altitude difference between both aircraft is obvious at a glance in comparison with a case wherein the surveillance instruction mark is represented by a trapezoid, which connects four points: two projection points of both aircrafts projected onto the ground surface and the two aircraft marks of the aircrafts. In particular, the surveillance instruction mark has an advantage to be capable of making the altitude difference of both aircrafts clear even when the altitude difference is small.

Figure 7:
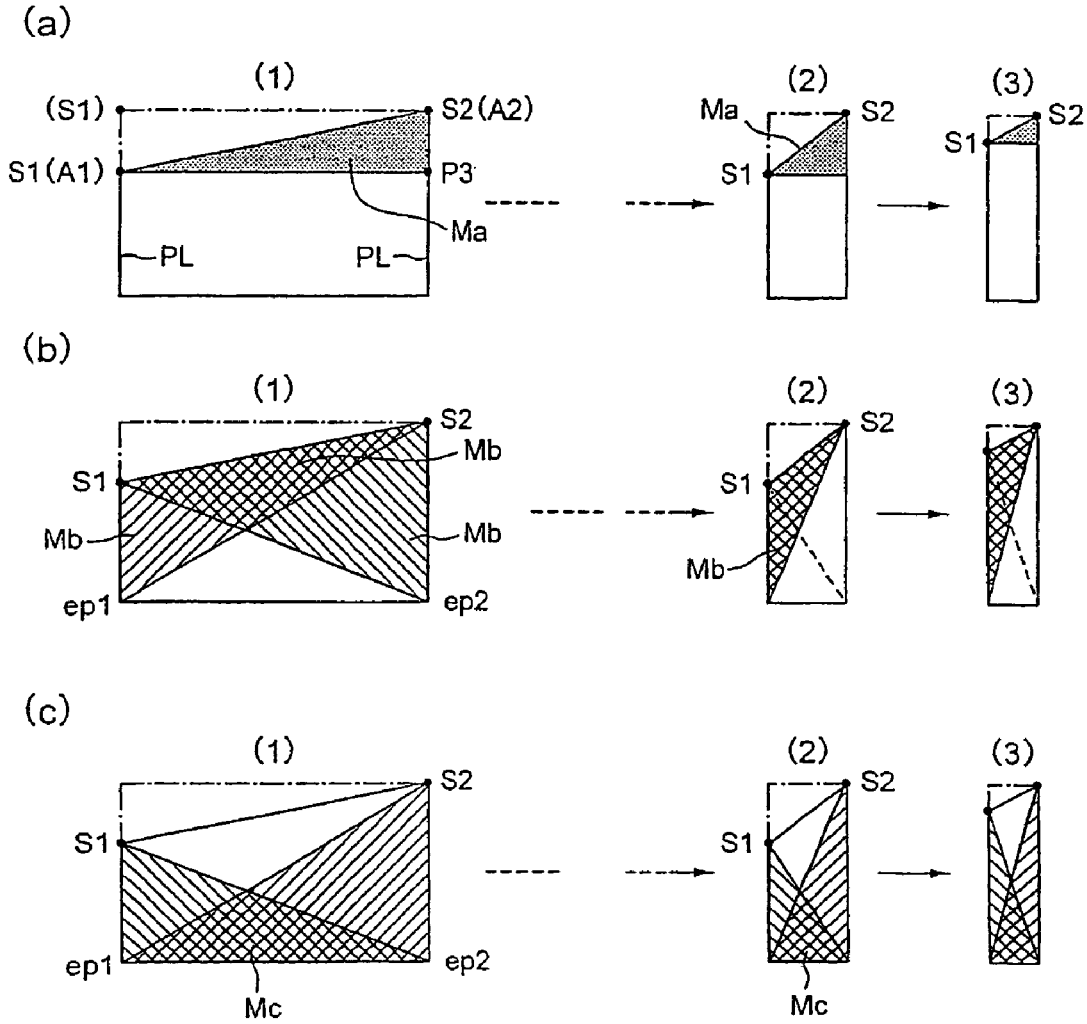
FIG. 7 are views showing examples of several kinds of display patterns for the surveillance instruction marks and examples of the surveillance instruction mark which is displayed when two aircraft are close to each other.

The surveillance instruction mark may be displayed in different kinds of compositions and display patterns as shown in FIGS. 7(*a*), 7(*b*) and 7(*c*) as examples.

The mode shown in FIG. 7(*a*), which has been stated, is a case wherein the surveillance instruction mark is a mark Ma comprising a triangle having, as three apexes, the aircraft marks S1 and S2 corresponding to two neighboring aircrafts A1 and A2, and the position P3 that is apart from one of the aircraft marks along the vertical line PL extending perpendicular to the one aircraft toward the ground surface of the terrain by a distance corresponding to the altitude difference between both aircraft on the display screen. The mode shown in FIG. 7(*b*) is a case wherein the surveillance instruction mark is a mark Mb comprising a triangle having, as three apexes, both aircraft marks S1 and S2, and the projection point ep1 (or ep2) of one of the aircraft marks S1 (or S2) projected onto the ground surface of the terrain. The mode shown in FIG. 7(*c*) is a case wherein the surveillance instruction mark is a mark Mc comprising a composition of two triangles, one of which has, as three apexes, one of the aircraft marks S1, and the projection points ep21 and ep2 of both aircraft marks projected onto the ground surface of the terrain, and the other of which has, as three apexes, the other aircraft mark S2, and the projection points ep1 and ep2 of both aircraft marks projected onto the ground surface of the terrain. In the mode shown in FIG. 7(*b*), the surveillance instruction mark may be a mark Mb' comprising a composition of two triangles, one of which has, as three apexes, both aircraft marks S1 and S2, and the projection point ep1 of one of the aircraft marks S1 projected onto the ground surface of the terrain, and the other of which has, as three apexes, both aircraft marks and the projection point ep2 of the other aircraft mark S2 projected onto the ground surface of the terrain.

In the mode of FIG. 7(*a*), when the two aircrafts have an equal altitude, the surveillance instruction mark is not a triangle shape but a straight line as indicated by a symbol S1 in FIG. 7(*a*). This mode is inferior in terms of visibility when the two aircrafts are closer to each other. Although the shape of the surveillance instruction mark is changing as shown in FIGS. 7(*a*)(1), 7(*a*)(2) and 7(*a*)(3) when the degree of approach between the two aircraft becomes greater, this mode has a disadvantage in that a controller pays lesser attention since the displayed area is reduced as the degree of approach increases. When the surveillance instruction mark becomes a straight line because of an equal altitude as shown in FIG. 7(*a*), it is preferable that the straight line is thicker to improve visibility. On the contrary, the modes shown in FIGS. 7(*b*) and (*c*) have an advantage in that even if two aircraft have an equal altitude, the surveillance instruction mark does not lose a triangle shape, and that even if the degree of approach increases as shown in FIGS. 7(*b*)(1), 7(*b*)(2) and 7(*b*)(3), and 7(*c*)(1), 7(*c*)(2) and 7(*c*)(3), the controller can continuously pay attention.

When the flight directions of both aircrafts are directions of being apart from each other as in the aircrafts A3 and A4 in FIG. 4, or when the flight directions of both aircrafts are the same as each other as in the aircraft A6 and A7, the aircraft A7 and A8, and the aircraft A8 and A9 in FIG. 6, the probability of occurrence of near miss or collision by a rapid approach is zero or quite low even if a surveillance instruction mark is displayed on the display screen 3' of the display unit 3. However, when both aircraft are flying in directions of being closer to each other, it is quite dangerous.

In such a case, an increase in the degree of danger can be recognized since the surveillance instruction mark is changing so that the displayed area is reducing. The surveillance instruction mark is displayed irrespective of the flight directions of respective aircrafts since the initial stage wherein neighboring aircrafts have come into the distance under surveillance. A controller who watches the display screen has to pay equal attention to all surveillance instruction marks displayed even in a case wherein he or she can pay less attention by recognizing the flight directions of aircrafts with a surveillance instruction mark applied thereto. Under the circumstances, the representation provided by the system is supposed to be one of the reasons for his or her fatigue.

Figure 8:
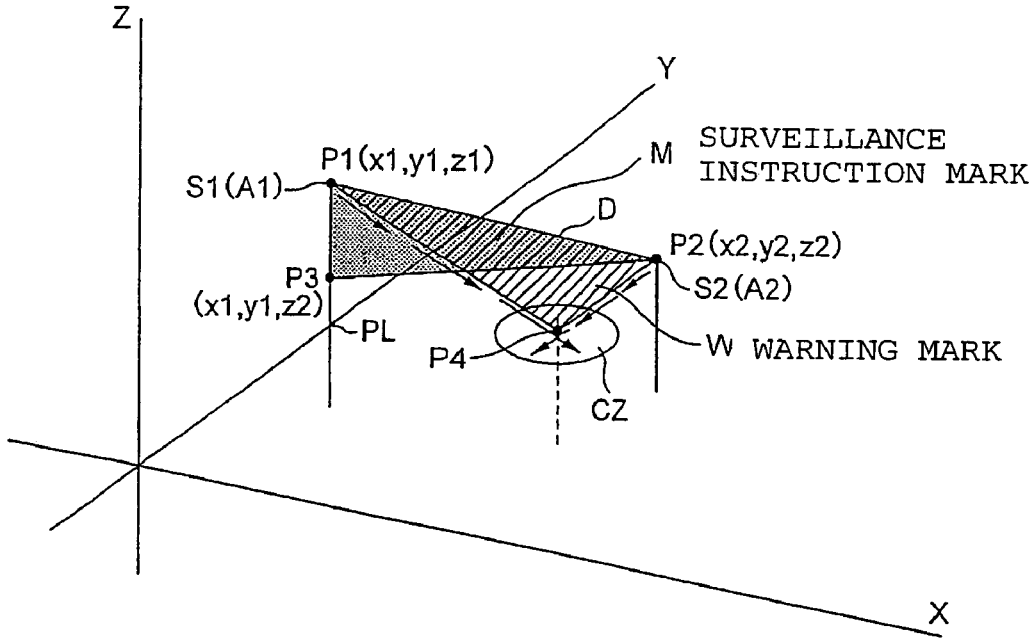
FIG. 8 is a schematic view showing how an example of a warning mark is prepared and displayed when the protective air spaces for two aircrafts conflict each other.

FIG. 8 shows another embodiment according to the present invention wherein it is possible to eliminate the disadvantage caused by displaying only the surveillance instruction mark as stated earlier. In this embodiment, a warning mark having a specific shape is displayed on the display screen to provide a warning so as to reliably recognize an increased risk of collision in a case wherein after a surveillance instruction mark has been displayed because of two neighboring aircraft entering a distance to be under surveillance, it is determined that the protective air spaces for both aircrafts conflict each other.

In other words, in the system shown in this embodiment, when the surveillance instruction mark comprises a triangle having, as three apexes, the aircraft marks S1 and S2 corresponding to two neighboring aircraft A1 and A2, and the position P3 that is apart from one of the aircraft mark along the vertical line PL extending perpendicular to the one aircraft toward the ground surface by a distance corresponding to the altitude difference between both aircrafts on the display screen as in the example shown in FIG. 2, flight prediction up to lapse of a certain period of time is performed based on the flight trajectories and the flight conditions. When the estimated arrival ranges of both aircrafts after the certain period of time are overlapped within a preset range, i.e., when the protective air spaces conflict each other, a point of mark is formed in the conflicted range, and a warning mark W, which comprises a triangle having the point of mark and both aircraft marks as three apexes, is displayed apparently in three dimensions on the display screen 3'.

Figure 9:
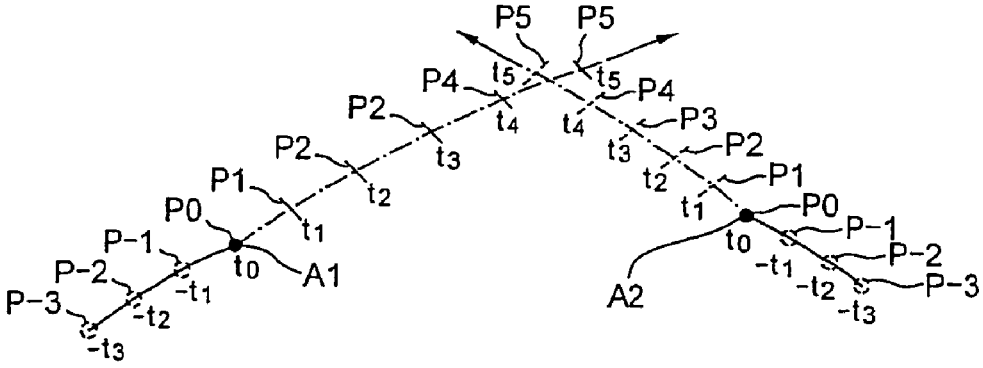
FIG. 9 is a schematic view explaining flight prediction for predicting whether the protective air spaces for two aircraft would conflict each other.

As an example, the flight prediction may be performed as follows: FIG. 9 shows a schematic view of flight prediction in a case wherein it is supposed that two aircrafts A1 and A2 have entered a distance to be under surveillance. Positions P-3, P-2 and P-1 are examples of positions that are plotted three cycles earlier (−t3, −t2 and −t1) than the current position P0 of an aircraft Ax. These series of position data show the flight trajectories. The operation section 204 performs prediction by calculating estimated arrival positions P1, P2 to P5 and further after lapse of each of the scan periods at t1, t2 to t5 and later with respect to the current position P0 based on the flight trajectories and the flight conditions given with respect to the respective aircraft. When one of the estimated arrival positions (protective air spaces) of one of both aircraft and one of the estimated arrival positions of the other aircraft are overlapped within a preset distance range, it is determined that there is a possibility of conflict. The operation section outputs a conflict prediction signal containing the position data of the overlapped air spaces to provide the signal to the 3D graphic engine section 201. Based on the conflict prediction signal, the 3D graphic engine section 201 forms a point P4 in a conflict zone CZ on the display screen corresponding to the overlapped air spaces as shown in FIG. 8. Subsequently, the 3D graphic engine section generates a triangle, i.e., a warning mark W having the point P4 and the aircraft marks S1 and S2 of both aircrafts as three apexes.

Thus, when it is predicted that protective air spaces for both aircrafts would conflict each other, the warning mark W in addition to the surveillance instruction mark M is displayed on the display screen 3' as shown in FIG. 8. Since aircraft, the flight directions of which are crossing, are provided with the warning mark W formed with a triangle having a point in the conflict-predicted air space (CZ) and both aircraft marks as the apexes (P4, P1, P2) as stated earlier, the warning mark W is clearly displayed even when both aircraft have an equal altitude. Accordingly, it is possible to effectively prevent a controller from overlooking the warning mark W. When two aircraft are flying in opposite directions at an equal altitude, each of the surveillance instruction mark and the warning mark is displayed as a single straight line. Although it is supposed that such a case would not actually occur, it is possible to avoid an error in visual recognition by making the straight lines thicker and flicking the straight lines.

Figure 10:
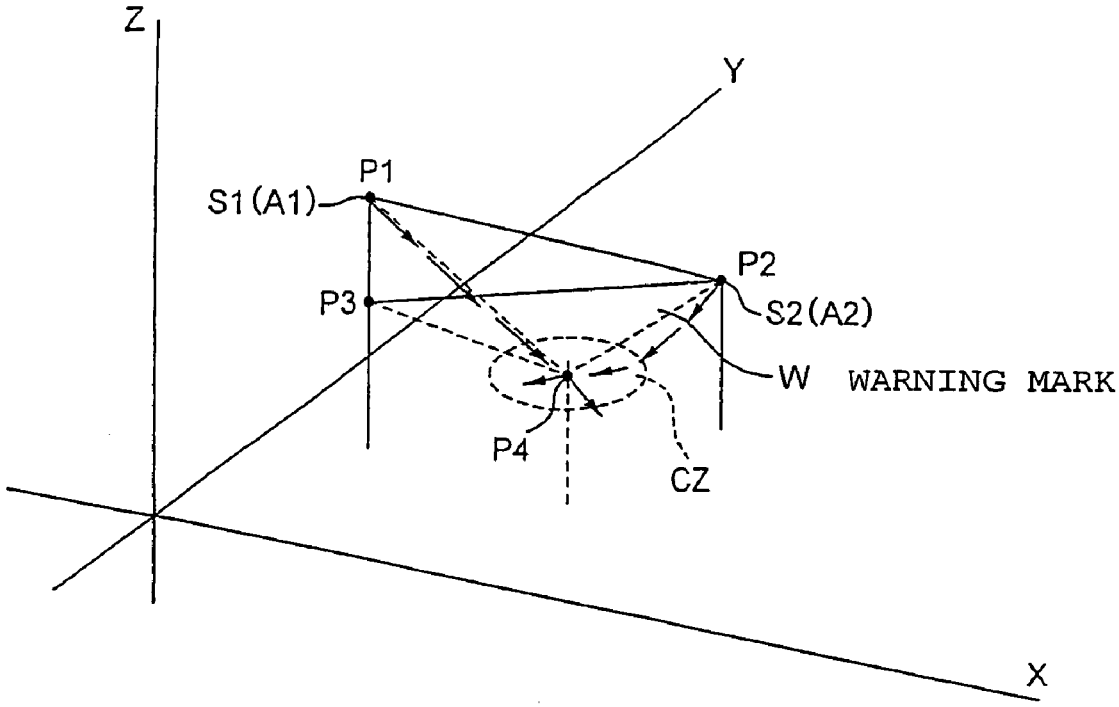
FIG. 10 is a schematic view explaining how another example of the warning mark is prepared and displayed.

As the shape of the warning mark, the shape shown in FIG. 10 may be adopted in addition to the triangle stated earlier. In the example shown in this figure, when it is determined that the distance between two aircraft is shorter than the threshold value, a triangle is created so as to have, as three apexes, the aircraft marks S1 and S2 corresponding to two neighboring aircrafts, and the position P3 that is apart from one of the aircraft mark along the vertical line extending perpendicular to the one aircraft toward the ground surface of the terrain by a distance corresponding to the altitude difference between both aircrafts on the display screen. Additionally, flight prediction is performed based on the flight trajectories and the flight conditions, and when the protective air spaces for both aircrafts conflict each other, a triangular pyramid is created so as to connect a point P4 in the conflicted range and the three apexes of the triangle and is utilized as the warning mark W.

The air traffic control information contains ground speed data and travel direction data in some cases. The air traffic control information about one aircraft is collected and stored at certain cycles while the aircraft exists in an air space under air traffic control. It is preferable that the flight trajectory of each of aircraft is formed by making use of these data, and that a combination of the flight trajectory and a velocity indicating vector DV having graduations at certain intervals showing speeds is displayed so as to extend behind an aircraft mark S. By this arrangement, it is possible to visually and accurately recognize the trajectory, the travel direction, the velocity and the like of each of the aircrafts apparently in three dimensions by only watching the vicinity of each of the aircraft mark on the display screen. It is acceptable to display only the flight direction by an arrow without displaying the flight trajectory and the speed.

By analyzing the trajectories of respective aircraft, it is possible to understand whether each of the aircraft is ascending or descending. From this viewpoint, what is effective to more precisely determine the degree of danger with respect to two aircraft existing in a distance to be under surveillance is that the aircraft marks are displayed so as to be accompanied by the velocity indicating vectors, and that the vertical lines L from the aircraft are painted in different colors to see whether each of the aircraft is ascending or descending.

As explained, in accordance with the first aspect of the present invention, the terrain of an air space under air traffic control is displayed apparently in three dimensions on the display screen, the aircraft marks of aircraft existing in the air space are displayed apparently in three dimensions on the display screen so as to correspond to the three-dimensional positions of the aircraft, and two neighboring aircraft, the distance between which is determined to be shorter than a distance to be under surveillance, is provided with a surveillance instruction mark having a certain shape apparently in three dimensions on the display screen. Accordingly, the approaching status and the flight conditions of neighboring aircraft can be comprehensively and visually recognized to effectively prevent a controller from neglecting necessary surveillance. Thus, it is possible to ensure the safety distance for aircraft so as to avoid the occurrence of near miss or collision between aircraft by an adequate and effective control command.

In accordance with the third aspect of the present invention, when aircraft are closer to each other, which level the degree of approach is at is displayed by a surveillance instruction mark having a certain display property. Accordingly, it is possible to recognize the degree of approach more intuitively and visually than a case wherein a controller ascertains the distance between aircraft by a numerical value. It is possible to rapidly and accurately perform necessary surveillance work.

In accordance with the fourth aspect of the present invention, the display property of a surveillance instruction mark is set so as to have stronger appeal as the degree of approach between both aircrafts increases. When multiple surveillance instruction marks are displayed, it is possible to perform effective surveillance work by giving priority to two aircrafts having a high risk. Accordingly, it is effective to avoid an accident.

In accordance with the fifth aspect of the present invention, respective aircraft marks are displayed so as to be accompanied by velocity indicating vectors. Accordingly, it is easy to perform the flight prediction of aircraft, which are closer to each other than the safety distance. Since the surveillance work can be performed with an increase or decrease in the degree of danger between two aircraft being predicted, it is possible to reduce the mental burden of a controller.

In accordance with the sixth and seventh aspects of the present invention, respective aircraft marks are displayed so as to be accompanied by velocity indicating vectors, the vertical lines from the aircrafts are painted in different colors to see whether each of the aircraft is ascending or descending, and the ground speeds of the aircraft are shown by differences in the thicknesses of the vertical lines. Accordingly, it is effective to more precisely determine the degree of danger between two aircrafts existing within a distance to be under surveillance.

In accordance with the eighth aspect of the present invention, the aircraft mark of an aircraft can be displayed by a reduced stereoscopic model corresponding to the size of the aircraft based on a call sign contained in the air traffic control information obtained with respect to an air space under air traffic control. Since a controller can visually recognize the size of the aircraft only by watching the aircraft mark displayed on the display screen, he or she can perform adequate surveillance work, which is suited for the size of the aircraft.

In accordance with the ninth aspect of the present invention, based on travel direction data of aircraft contained in the air traffic control information or travel direction determined in terms of the flight trajectory of the aircraft, the attitude of a reduced stereoscopic model showing the aircraft mark is displayed so as to accord with the travel direction.

Accordingly, it is possible to momentarily and visually recognize the flight direction of the aircraft only by watching the aircraft mark on the display screen. It is also possible to prevent a controller from issuing a wrong control command due to misrecognition in terms of the flight direction.

In accordance with the tenth aspect of the present invention, in a case wherein there is a danger of conflict if two aircrafts continue to fly as they are, the occurrence of conflict is predicted, and a warning mark is displayed. Accordingly, it is possible to invite a controller attention more effectively and reliably than a case wherein a surveillance instruction mark is displayed only when the aircrafts are closer to each other than the safe distance.

In accordance with the eleventh aspect of the present invention, a warning mark is displayed so as to have a triangular pyramid shape, which is superior to the triangle warning mark in the tenth aspect in terms of visibility.

In accordance with the twelfth aspect of the present invention, the display positions of an aircraft mark from the current scan time to the next scan time can be stored and displayed. It is possible to effectively avoid misunderstanding of a flight status, which can be created because the aircraft mark is failed to be displayed momentarily under the influence of the scan cycle.

In accordance with the thirteenth aspect of the present invention, it is possible to improve the reliability in the display position of an aircraft mark since it is possible to ascertain whether renewal has been made.

The invention claimed is:

1. A method for displaying aircraft positions, comprising:

displaying a terrain apparently in three dimensions on a display screen based on topographic data corresponding to an air space under air traffic control;

finding three-dimensional positions of respective aircraft based on position data and altitude data of the respective aircraft contained in air traffic control information obtained about the air space under air traffic control, and displaying aircraft marks indicating the respective aircraft at positions on the display screen so as to correspond to the three-dimensional positions of the respective aircrafts;

finding a distance between two neighboring aircraft, and determining whether the distance between the two neighboring aircraft is shorter than a safety distance; and displaying a surveillance instruction mark apparently in three dimensions on the display screen, the surveillance instruction mark comprising a triangle having three apexes, the three apexes comprising the aircraft marks of the two neighboring aircraft and a point having a specific relationship with the aircraft marks, when it is determined that the distance between two neighboring aircraft found is shorter than the safety distance.

2. The method according to claim 1, wherein the surveillance instruction mark is one of (a) a mark comprising a triangle having three apexes comprising the aircraft marks corresponding to the two neighboring aircraft, and a position that is apart from one of the aircraft marks along a vertical line extending perpendicular to the one aircraft toward a ground surface by a distance corresponding to an altitude difference between both of the two neighboring aircraft on the display screen; (b) a mark comprising a triangle having three apexes, which comprise both aircraft marks, and a projection point of one of the aircraft marks projected onto the ground surface; and (c) a mark comprising a composition of two triangles, one of which has three apexes comprising one of the aircraft marks, and projection points of both aircraft marks projected onto the ground surface of the terrain, and the other of which has three apexes comprising the other aircraft mark, and the projection points of both aircraft marks projected onto the ground surface of the terrain.

3. The method according to claim 1 or 2, wherein the method further comprises:

finding the inter-aircraft distance between the two neighboring aircraft based on the position data and the altitude data with respect to the two neighboring aircraft; and displaying the surveillance instruction mark with different display properties in accord with one of multiple stages of distance ranges indicating a degree of approach between the two neighboring aircraft, when the distance between the two neighboring aircraft is shorter than the safety distance.

4. The method according to claim 3, wherein the display properties of the surveillance instruction mark are more apparent as the degree of approach between both aircraft increases.

5. The method according to claim 1 or 2, wherein travel directions and ground speeds of the two neighboring aircraft are indicated by vectors based on travel direction data and ground speed data contained in the air traffic control information transmitted from the two neighboring aircraft, the vectors extending from the respective aircraft marks in the respective travel directions and having graduations.

6. The method according to claim 1 or 2, wherein the vertical lines extending from the respective aircraft marks onto the ground surface of the terrain are displayed in different colors corresponding to whether each of the two neighboring aircraft is ascending or descending.

7. The method according to claim 1 or 2, wherein the vertical lines extending from the respective aircraft marks onto the ground surface of the terrain are displayed in different colors corresponding to whether each of the two neighboring aircraft is ascending or descending, and ground speed levels of the two neighboring aircraft are indicated by different thicknesses of the vertical lines.

8. The method according to claim 1 or 2, wherein the aircraft marks are stored as reduced stereoscopic models, having respective sizes proportional to sizes of the respective two neighboring aircraft; and the aircraft marks of the respective two neighboring aircraft are displayed by the reduced stereoscopic models of the respective two neighboring aircrafts based on call signs contained in the air traffic control information obtained about the air space under air traffic control.

9. The method according to claim 8, wherein that the reduced stereoscopic models are displayed so as to have attitudes accorded with respective travel directions based on travel direction data contained in the air traffic control information or based on respective travel directions based on respective flight trajectories of the two neighboring aircraft obtained by processing the air traffic control information.

10. A method for displaying aircraft positions, comprising:

displaying a terrain apparently in three dimensions on a display screen based on topographic data corresponding to an air space under air traffic control;

finding three-dimensional positions of respective aircrafts based on position data and altitude data of the respective aircrafts contained in air traffic control information obtained about the air space under air traffic control, and displaying aircraft marks indicating the respective aircraft at positions on the display screen so as to correspond to the three-dimensional positions of the respective aircraft;

finding a distance between two neighboring aircraft, and determining whether the distance between the two neighboring aircraft is shorter than a safety distance;

displaying (a) a surveillance instruction mark and (b) a warning mark apparently in three dimensions on the display screen when it is determined that the distance between two aircraft found is shorter than the safety distance, wherein the surveillance instruction mark comprises a triangle having three apexes; including aircraft marks corresponding to the two neighboring aircrafts, and a position that is apart from one of the aircraft marks along a vertical line extending perpendicular to the one aircraft toward a ground surface by a distance corresponding to an altitude difference between both of the two neighboring aircraft on the display screen, and wherein the warning mark comprises a triangle having three apexes including a point in an overlapped range and both aircraft marks, when estimated arrival ranges of both of the neighboring aircraft after a certain period of time are overlapped according to a prediction of flight up to a lapse of the certain period of time, the estimated arrival ranges based on flight trajectories and flight conditions of the two neighboring aircraft.

11. A method for displaying aircraft positions, comprising:

displaying a terrain apparently in three dimensions on a display screen based on topographic data corresponding to an air space under air traffic control;

finding three-dimensional positions of respective aircrafts based on position data and altitude data of the respective aircrafts contained in air traffic control information obtained about the air space under air traffic control, and displaying aircraft marks indicating the respective aircraft at positions on the display screen so as to correspond to the three-dimensional positions of the respective aircrafts;

finding a distance between two neighboring aircraft, and determining whether the distance between the two neighboring aircraft is shorter than a safety distance;

forming a triangle when the distance between the two neighboring aircraft is shorter than the safety distance, the triangle having three apexes comprising the aircraft marks corresponding to the two neighboring aircraft, and a position that is apart from one of the aircraft marks along a vertical line extending perpendicular to the one aircraft toward a ground surface of terrain by a distance corresponding to an altitude difference between both of the two neighboring aircrafts on the display screen, and displaying a triangular pyramid as a warning mark in a three-dimension-like way when estimated arrival ranges for both of the two neighboring aircraft after a certain period of time are overlapped according to flight prediction based on flight trajectories and flight conditions of the two neighboring aircraft, the warning mark connecting the three apexes of the triangle and a point in an overlapped range for both of the two neighboring aircraft.

12. The method according to any one of claims 1 and 11, further comprising:

displaying the aircraft marks in an interpolated way by displaying the aircraft marks on the display screen based on latest air traffic control information obtained about the respective neighboring aircraft, and processing of the interpolated display by making use of flight trajectories of the respective aircrafts until obtaining next air traffic control information.

13. The method according to claim 12, wherein when display has been renewed based on the latest air traffic control information, the aircraft marks are displayed in a stressed way for recognition of renewal.

* * * * *